US005137080A

United States Patent [19]

Haasch et al.

[11] Patent Number: 5,137,080

[45] Date of Patent: Aug. 11, 1992

[54] VEHICULAR RADIATOR AND MODULE CONSTRUCTION FOR USE IN THE SAME

[75] Inventors: James T. Haasch, Bay View, Wis.; Stanley F. Meizelis, Jr., Peoria, Ill.; Robert F. Poehlman, South Milwaukee; Charles J. Rogers, Racine, both of Wis.; Raymond D. Stratton, Sparland, Ill.

[73] Assignees: Caterpillar Inc., Peoria, Ill.; Modine Manufacturing Company, Racine, Wis.

[21] Appl. No.: 718,241

[22] Filed: Jun. 20, 1991

[51] Int. Cl.[5] ..... F28F 9/06

[52] U.S. Cl. ..... 165/78; 165/69; 165/176; 165/76

[58] Field of Search ..... 165/76, 78, 176, 69

[56] References Cited

U.S. PATENT DOCUMENTS

| | | | |
|---|---|---|---|
| 130,088 | 7/1872 | Walker | 165/176 |
| 135,645 | 2/1873 | Hinckley . | |
| 1,606,739 | 11/1926 | Averill . | |
| 3,459,258 | 7/1966 | Wagner . | |
| 3,628,603 | 12/1971 | Fieni . | |
| 3,776,303 | 12/1973 | Anderson et al. . | |
| 3,792,729 | 2/1974 | Perry . | |
| 4,191,244 | 3/1980 | Keske | 165/69 |
| 4,266,604 | 5/1981 | Sumikawa et al. . | |
| 4,295,521 | 10/1981 | Sommars | 165/69 |
| 4,381,033 | 4/1983 | Woodhull, Jr. et al. . | |
| 4,576,223 | 3/1986 | Humpolik et al. . | |
| 4,625,793 | 12/1986 | Cadars . | |
| 4,741,392 | 5/1988 | Morse | 165/76 |
| 4,771,825 | 9/1988 | Chen et al. . | |

FOREIGN PATENT DOCUMENTS

| | | | |
|---|---|---|---|
| 487865 | 6/1918 | France | 165/76 |
| 111478 | 11/1918 | United Kingdom | 165/76 |

*Primary Examiner*—Albert W. Davis, Jr.
*Attorney, Agent, or Firm*—Wood, Phillips, Van Santen, Hoffman & Ertel

[57] ABSTRACT

Difficulty in heat exchanger module replacement and the cost of plural manifolds in a modular heat exchanger useful in heavy duty vehicles or the like is avoided in a construction that includes an elongated manifold (20) having spaced interior inlet and outlet channels (84, 86) along with a plurality of spaced inlet and outlet ports (68, 70) in fluid communication with respective ones of the inlet and outlet channels (84, 86). An elongated frame member (14) is spaced from and parallel to the manifold (22) and has a plurality of spaced retaining formations (42). A plurality of heat exchanger modules (12) are mounted between the frame member (14) and the manifold (20) in side by side relation and each module has spaced tanks (34, 36; 50, 52) with a plurality of finned tubes (30, 32) extending between and in fluid communication therewith. One tank (34, 36) has a mating retaining formation (40) for receipt within the retaining formation (42) in the frame member (14) while the other tank (50, 52) has inlet and outlet ports (62, 64) aligned with and in fluid communication with corresponding inlet and outlet ports (68 and 70) in the manifold (20). A baffle (60) is disposed in the tank (50, 52) between the inlet and outlet ports (62, 64) thereof.

28 Claims, 5 Drawing Sheets

VEHICULAR RADIATOR AND MODULE CONSTRUCTION FOR USE IN THE SAME

FIELD OF THE INVENTION

This invention relates to modular heat exchangers, and more particularly, to heat exchangers that may be used as radiators in heavy vehicle applications.

BACKGROUND OF THE INVENTION

The cost of much heavy duty equipment as, for example, off the road vehicles or construction equipment, is such that it must be kept in use relatively constantly in order to amortize the cost at a profitable rate. In addition, many construction contracts include incentive clauses and/or penalties to respectively encourage the contractor to complete the project ahead of schedule or maintain the project on schedule. Both of these factors strongly suggest that such equipment be designed so that down time due to vehicle malfunction is absolutely minimized.

Since vehicles and construction equipment of this sort absolutely cannot operate properly unless their engines are adequately cooled, all precautions are taken to ensure that the cooling systems for such engines are long lived and easy to maintain. As a result of this particular concern, the so-called modular radiator has evolved.

In modular radiators, relatively small cores, that is, fin and tube structures, are lined up in side-by-side relationship as individual modules extending between headers. If a leak is encountered in one of the modules as a result of operation of the vehicle or other factors, it is much less time-consuming to change the leaky module than to replace the entire radiator. As a consequence, considerable down time is avoided and the vehicle may be restored to service much more rapidly.

Modular radiators are not, however, without disadvantages of their own. For one thing, they are considerably more costly to initially assemble. For another, many such modular radiators occupy more space on the vehicle than is desired because the frames of the modular radiators have to be designed so as to allow relative movement of the modules with respect to each other so that one may be removed or installed without touching the others.

More recently, a modular radiator having heat exchange modules including finned tubes extending between spaced tanks has been proposed in U.S. Pat. No. 4,741,392, issued May 3, 1988 to James Morse. While the Morse construction has avoided a number of the problems heretofore evidenced in the use of modular radiators, its requirement of two tanks for each module coupled with two manifolds is a cost disadvantage.

The present invention is directed to overcoming one or more of the above problems.

SUMMARY OF THE INVENTION

It is the principal object of the invention to provide a new and improved modular heat exchanger construction. It is also an object of the invention to provide a new and improved module for use in a modular heat exchanger.

An exemplary embodiment of the invention achieves one or more of the foregoing objects in a module construction, including first and second spaced tanks. A plurality of finned tubes extend between and are in fluid communication with the tanks. One tank has a mating retaining formation that is adapted to mate with a corresponding retaining formation on a modular heat exchanger frame and the other tank has at least one port in fluid communication with its interior for the introduction or egress of a heat exchange fluid. A baffle is located in the latter tank and location so as to prevent the flow of fluid from the port to the side of the baffle remote from the port within the tank except through the tubes, the first-mentioned tank and a return by other tubes.

In a highly preferred embodiment, the tubes are in a plurality of rows and there are a plurality of tubes in each such row. The fins extend between the tubes on the exterior thereof and the retaining formation is in the form of a retaining stud or snout.

In a preferred embodiment, the tank containing the baffle includes an additional fluid port on the side of the baffle opposite the first port. One of the ports thus may serve as an inlet and the other may serve as an outlet and a two-pass heat exchange module is defined as a consequence.

In a highly preferred embodiment, the retaining formations or snouts are oriented on the tanks so that the module may be located in a frame in either of two positions 180° apart about an axis extending between the tanks. More particularly, each module has a center line and the snout or retaining formation is located on the center line while the ports are diametrically opposite about the center line and equally spaced from the center line.

In one embodiment, the tubes have flattened sides and the baffle is elongated and is generally transverse to the flattened sides.

A heat exchanger embodying a plurality of the modules typically includes an elongated frame member having a plurality of positioning formations extending along its length which are complementary to the mating positioning formations on the first mentioned tanks. Also provided is an elongated manifold that is parallel to the frame member and which has spaced, interior inlet and outlet channels. A plurality of spaced inlet and outlet ports are located along the manifold for connection with corresponding ports on the modules and each is in fluid communication with the appropriate one of the inlet and outlet channels.

The manifold has a front side and a rear side. When used in association with a blower fan, the inlet channel is nearer the front side than the outlet channel. When used with a sucker, the inlet channel is nearer the rear. As a consequence, a two-pass, counterflow heat exchanger is provided for high efficiency.

In a highly preferred embodiment, the manifold itself is made up of a plurality of manifold modules in side-by-side sealed relation and each of the manifold modules has at least one inlet port and at least one outlet port. The channels in the modules of the manifold are aligned and sealed to one another.

The invention contemplates the provision of resilient seal means between the tanks having the ports and the manifold, along with a vibration damper between the other tanks and the frame member.

Preferably, the resilient seal means is a rubber grommet tailored to fit between the manifold and each of the tanks having the ports. The vibration damper is a rubber grommet that fits over each of the other tanks to insulate the tanks from the frame member. The damper has an inner ledge and an outer ledge with a channel in between wherein the outer ledge is shorter than the inner ledge.

The invention further contemplates that the heat exchanger be employed in a vertical orientation wherein the frame member is uppermost and the manifold is lowermost.

In a highly preferred embodiment of a heat exchanger, an elongated manifold has spaced interior inlet and outlet channels, a plurality of inlet ports along the manifold, each in fluid communication with the outlet channel, and an elongated frame member spaced from and parallel to the manifold having a plurality of spaced retaining formations thereon. A plurality of heat exchanger modules are mounted between the frame member and the manifold in side-by-side relation. Each module has first and second spaced tanks with a plurality of finned tubes extending between and in fluid communication with the tanks. The first tank has a mating retaining formation mating with a corresponding mating formation on the frame member. The second tank has an inlet and an outlet port aligned with and in fluid communication with a corresponding inlet port and a corresponding outlet port in the manifold. A baffle is positioned in the second tank between the inlet and outlet ports thereof to isolate the same from each other within the tank. The first tank has at least one vent to the exterior of the tank mating retaining formation. The modular vent is connectable to adjacent module vents so adjacent modules can be in fluid communication thereat. In particular, each module has two tubular vents extending therefrom with a U-shaped tube connecting adjacent vents between adjacent modules.

Other objects and advantages will become apparent from the following specification taken in connection with the accompanying drawings.

DESCRIPTION OF THE PREFERRED EMBODIMENTS

Figure 1:
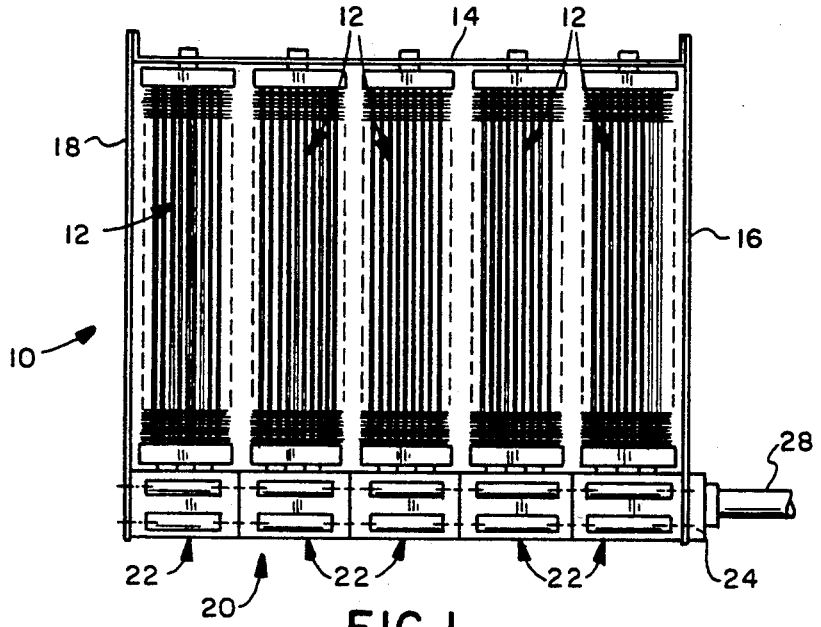
FIG. 1 is an elevation of a modular heat exchanger made according to the invention.

An exemplary embodiment of a modular radiator made according to the invention is illustrated in FIG. 1 and with reference thereto, is seen to include a frame, generally designated 10, which, in turn, receives a plurality of individual heat exchange modules, each generally designated 12. Typically, but not always, the modules 12 will all be of equal length.

The frame 10 is made up of an upper, tank retainer 14 which is in the form of an elongated, upwardly-opening U-shaped bar. At its ends, the tank retainer 14 is releasably joined to right and left side pieces 16 and 18.

Figure 5:
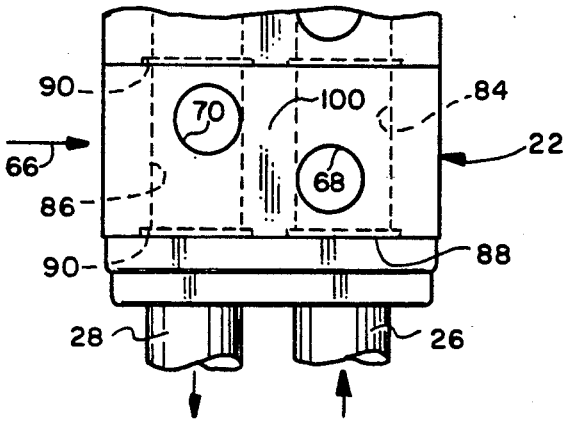
FIG. 5 is a top view of one of the manifold modules with an associated inlet and outlet fitting attached thereto.

Lowermost in the frame is a lower frame member which also serves as a manifold and is generally designated 20. As will be seen, the manifold 20 is made up of a plurality of manifold modules, each generally designated 22, for purposes to be seen. At one end, the manifold 20 may have mounted thereto an inlet/outlet fitting 24 which, in turn, is connected to inlet and outlet conduits 26, 28 (FIG. 5).

Figure 2:
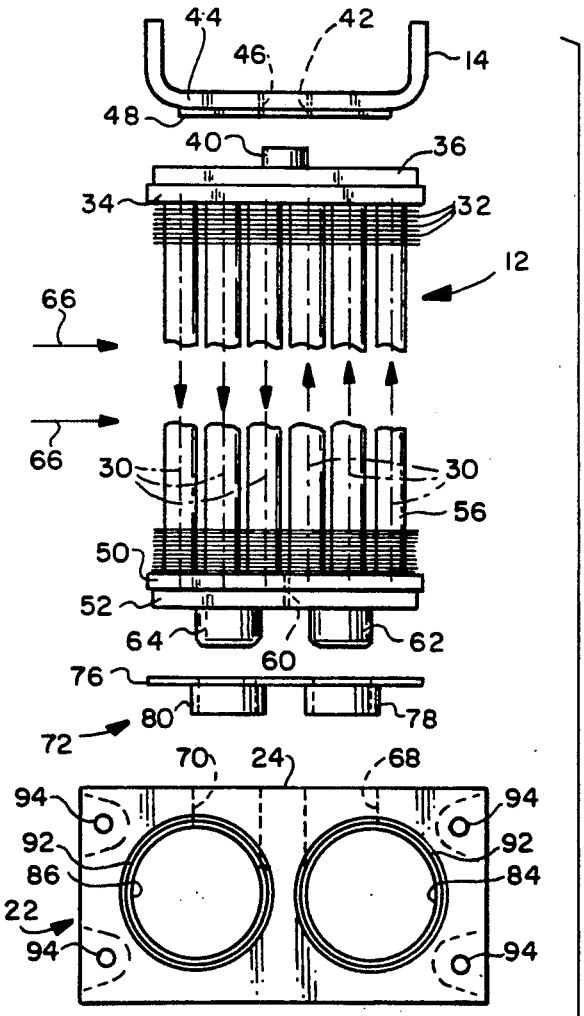
FIG. 2 is an exploded, side elevation of the modular heat exchanger.
Figure 3:
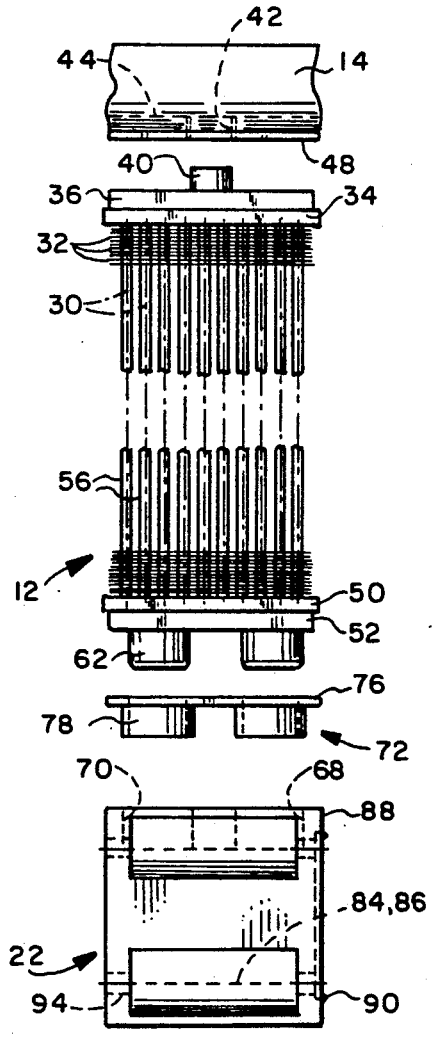
FIG. 3 is an exploded front elevation of the modular heat exchanger.

Looking first at FIGS. 2 and 3, each module 12 includes a plurality of tubes of oval or flattened cross-section shown at 30. As illustrated in FIGS. 2 and 3, there are six rows of ten tubes each. Fins 32 extend between the exteriors of the tubes in the various rows. As illustrated, the fins are so-called plate fins, but it will be appreciated by those skilled in the art that serpentine fins could be employed.

At the upper end of each of the tubes 30 is an upwardly opening, cupped shaped header plate 34 through which the tubes 30 extend and to which the tubes may be bonded and sealed in any desired fashion. Preferably, the connection and sealing is such as that sold under the trade mark Beta-Weld® by one of the assignees of the instant application. A downwardly opening, shallow cup-shaped tank half 36 is received within the header plate 34 and sealed thereto. In the embodiment illustrated, the header plate 34 and tank half 36 are made of metal such as copper or brass and may be soldered, welded or brazed together. However, it should be appreciated that plastic components may be utilized as well. In any event, the header plate 34 and the tank half 36 define one tank at the end of the bundle of tubes 30 or at the end of a core defined by the tubes 30 and the fins 32.

Projecting upwardly from the upper exterior surface of the tank half 36 is a positioning snout or stud 40. The stud 40 is adapted to be received in an aperture 42 within the bight 44 of the tank retainer 14. Desirably, a resilient bushing 46 is interposed between the sides of the aperture 42 and the stud 40 for vibration in isolation purposes. In a like vein, a resilient pad 48 is positioned between the underside of the bight 44 and the upper surface of the tank 36 to serve as a vibration dampener. In a preferred embodiment, the bushing 46 and the pad 48 will be integrally formed.

Oppositely of the tank defined by the header plate 34 and the tank half 36, the tube bundle terminates in a second header plate 50 in which the ends of the tubes 30 are bonded and sealed just as the header plate 34. Like the header plate 34, the header plate 50 is somewhat cupped shaped, but opens downwardly to receive a shallow, cupped shaped upwardly opening tank half 52. Again, the components are of a metal such as copper or brass, but may be of plastic if desired.

Figure 4:
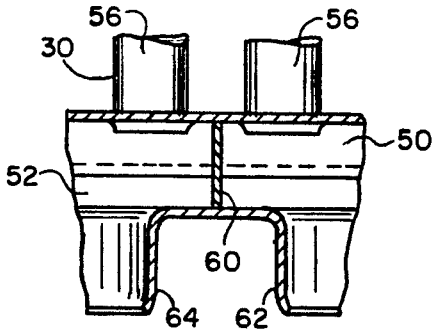
FIG. 4 is a fragmentary, enlarged, sectional view of one of the tanks of the module.

As alluded to previously, the tubes 30 are oval tubes, that is, of the type having opposed flattened sides 56. Within the lower tank defined by the header plate 50 and tank half 52 and midway between the rows of tubes 30, here, between three rows to the left and three rows to the right, is an elongated baffle (FIGS. 2 and 4) 60 which divides the lower tank into two substantially equal volume sections. In a module having furrows of tubes, the baffle is positioned between two and a half rows to left and right. On one side of the baffle 60 is a downwardly-extending nipple 62 which serves as a fluid inlet port to the lower tank defined by the header plate 50 and tank 52. On the opposite side of the baffle 60 is a downwardly extending nipple 64 which serves as an outlet port for such tank. Because of the presence of the baffle 60, it will be appreciated that fluid entering the module 12 through the inlet 62 cannot flow directly to the outlet 64 via the lower tank. Rather, it must flow upwardly through the rightmost three rows of tubes 30 as viewed in FIG. 2 to the upper tank defined by the header 34 and tank half 36. At this point, the same may flow to the left and then descend through the leftmost three rows of tubes ultimately to the lower tank and out of the outlet 64.

Preferably, the arrangement is set up so that the flow of the second heat exchange fluid, usually air, is in the direction of arrows 66 as illustrated in FIG. 2. Thus, incoming coolant when the heat exchanger is used as a radiator, begins at the back or downstream side of the module and flows forwardly to provide a counterflow arrangement along with a two-pass arrangement by reason of the provision of the baffle 60.

The nipples 62 and 64 are adapted to be received in respective female ports or bores 68 and 70 in one of the manifold modules 22. For sealing purposes, a seal, generally designated 72, is interposed between the lower tank and the upper surface 74 of each of the modules 22. Each seal 72 includes a flat planar section 76 and two generally cylindrical sections 78 and 80 which depend from the flat section 76. The cylindrical sections 78 and 80 are sized to fit within the female ports 68 and 70 within each manifold module 22 to seal the sides of the same against the sides of the nipples 62 and 64. The flat section 76 serves to seal and isolate the manifold 20 from the modules 12 for vibration isolation purposes.

As can be seen in FIGS. 2, 3 and 5, each of the manifold modules 22 includes an inlet channel 84 and an outlet channel 86. The inlet ports 68 are in fluid communication with the inlet channel 84 and the outlet ports are in fluid communication with the outlet channels 86. On one face 88 of each manifold module 22, a peripheral recess 90 is located about each of the channels 84, 86 and is adapted to receive an 0-ring seal 92. This enables the individual manifold modules 22 to be stacked together with the channels 84 and 86 and each aligned and, by means of bores 94, receive tie bolts (not shown) that hold the same in assembled relation as illustrated in FIG. 1. The 0-ring seals, 92 thus seal the interfaces of the individual modules 22.

The fitting 24 may be held in place by the very same tie bolts as desired.

An important feature of the invention is the fact that each of the modules 12 has a centerline extending between the upper and lower tanks and upon which the stud 40 is centered. The location of the centerline as it would hypothetically appear if extended to one of the manifold modules 22 is illustrated in FIG. 5 at point 100 and it would be observed that the ports 68 and 70 which are, of course, aligned with the nipples 62 and 64 on the lower tank, are diametrically opposite from one another about the centerline and equally spaced therefrom.

This orientation makes installation of a module into the frame possible by even the least skilled labor. The module can only be placed in the frame in one of two positions 180° apart about the centerline of the module and in either position, the baffles 60 will be transverse to the direction of air flow 66 which is to say that the flat sides 56 of the tubes 30 will be parallel to the direction of air flow 66 which is desired. Should the installer inadvertently reverse the location of the module 22 such that the outlet port 64 thereof is disposed within the inlet port 68 of the corresponding manifold module 22, and the inlet port 62 of the module is disposed within the manifold port 70, it will make no difference because of the aforementioned relationship and the components will function properly.

Another exemplary and highly preferred embodiment of a modular radiator made according to the invention is illustrated in FIGS. 6 through 16.

Figure 6:
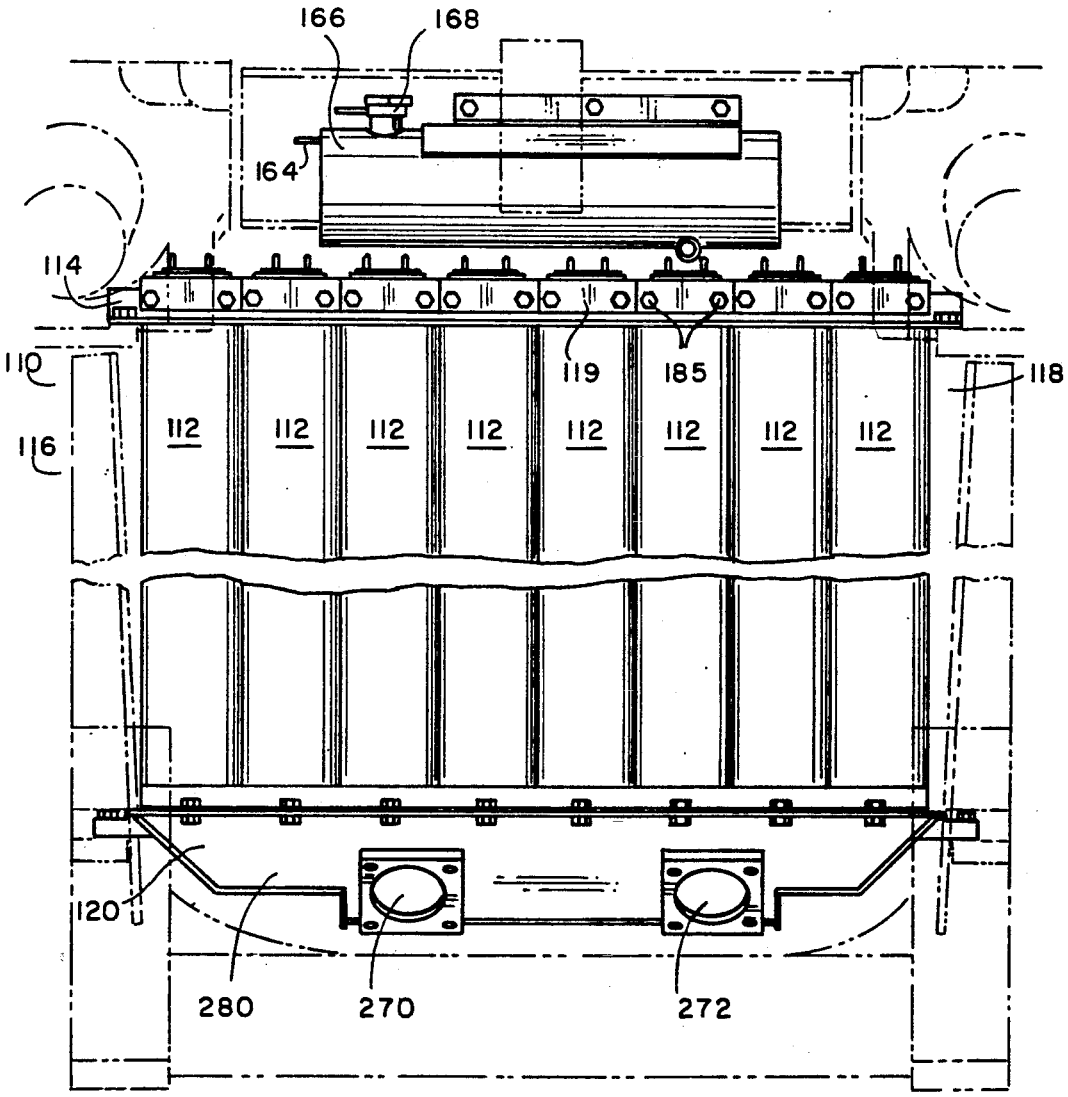
FIG. 6 is an elevation of another embodiment of a modular heat exchanger made according to the invention.

Referring to FIG. 6, a modular radiator includes a rectangular frame, generally designated 110, which receives a plurality of individual heat exchange modules, each generally designated 112. The frame 110 is made up of an upper, tank retainer 114 which is in the form of an elongated L-shaped bar releasably joined on ends to spaced, vertical side pieces 116 and 118 and mounting a plurality of retaining plates 119, one for each module. In an alternate embodiment, one plate may be used for one, two or more modules. Lowermost in the frame is a lower frame member 120 which also serves as a manifold.

Figure 7:
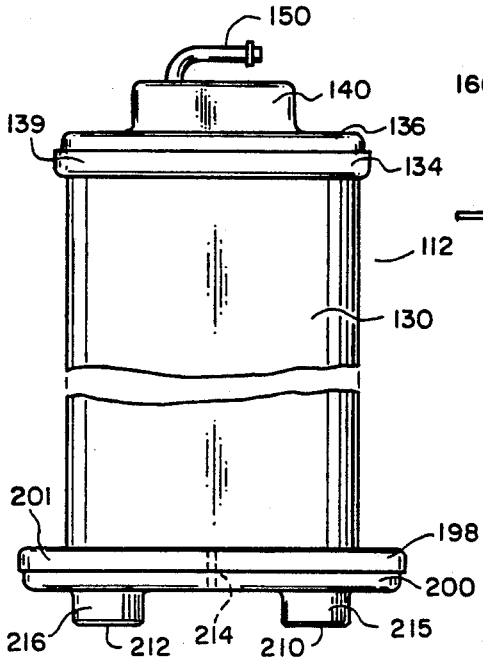
FIG. 7 is a side elevation of an isolated heat exchange module from FIG. 6.

Referring to FIG. 7, each module includes a plurality of tubes of oval or flattened cross section 130, as in the previous embodiment. At the upper end of each of the tubes 130 is an upwardly-opening cup-shaped header plate 134 through which the tubes 130 extend and to which the tubes may be bonded and sealed as in the previous embodiment. A downwardly-opening, shallow cup-shaped tank half 136 is received within the header plate 134 and sealed thereto. The header plate 134 and tank half 136 define a tank 139 at the upper end of the module. As in the previous embodiment, the tank 139 and retaining plates 119 are made of metal, but, plastic components may be utilized as well.

Projecting upwardly from the upper exterior surface of the tank half 136 is a positioning snout or stud 140. The stud 140 is adapted to be received in a corresponding retaining plate 119 (FIGS. 6, 8 and 9), as will be seen. The top of each stud 140 has at least one vent tube 150 projecting therefrom. As can be seen in FIG. 6, in a preferred embodiment there are two tubes projecting from each stud 140. The tubes 150 protrude vertically upward and bend to extend horizontally, all within the envelope of the corresponding stud 140. The tubes 150 are in fluid communication with the interior of the corresponding tank 139 and function as vents for gases or vapors that can result from combustion gas leaks in the engine. They also vent air from the top of each module when the radiator is being filled with coolant and cooperate to allow expansion of coolant as will be seen.

Figure 9:
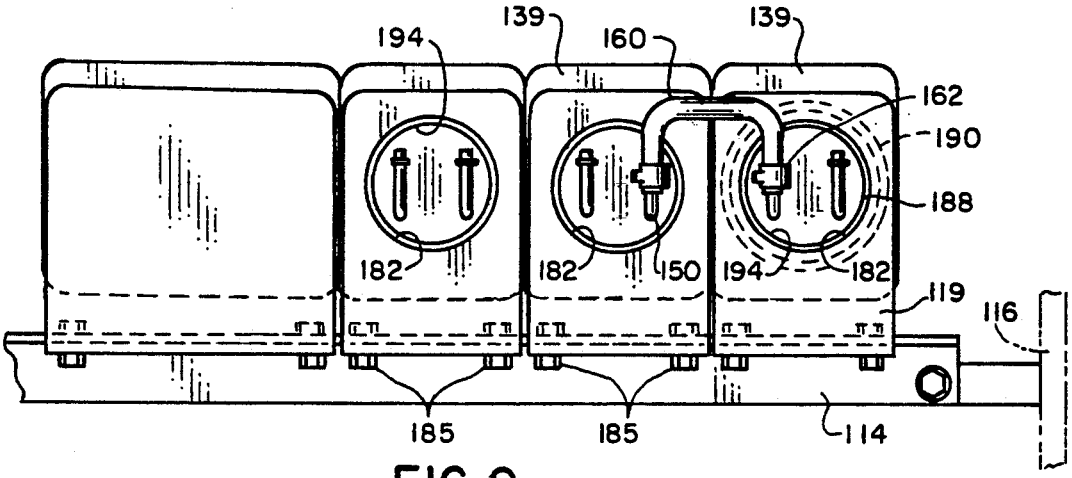
FIG. 9 is a top view of the modular heat exchanger of FIG. 6.
Figure 10:
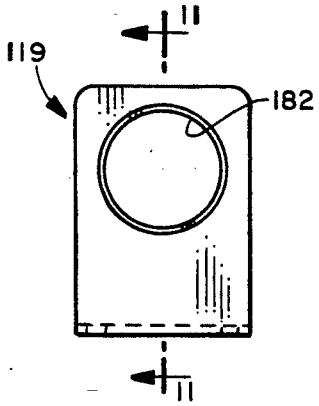
FIG. 10 is a top view of an upper tank retainer.

Referring to FIG. 9, the adjacent vents of adjoining modules are brought into fluid communication by vent hoses 160. Each vent hose 160 is U-shaped and fits around the horizontal portions of the tubes 150. The hose 160 is secured in place by means of clamps 162. Though only one is shown, it can be seen that all adjacent modules can be similarly linked. In that way, the gases which are produced through evaporation are vented through the tubes 150 and passed along the length of the radiator through the upper tanks 139 of all of the modules 112 by way of vent hoses 160.

One tube at one end of the row of modules can be clamped shut. At the other end of the row, a tube may be connected via a hose (not shown) to a port 164 (FIG. 6) of a conventional shunt tank 166. The tank 166 includes a conventional fill and pressure cap 168. Thus, the tubes 150 also serve as a means whereby hot coolant whose volume has increased as a result of heating may be conveyed to the expansion tank 166.

Figure 8:
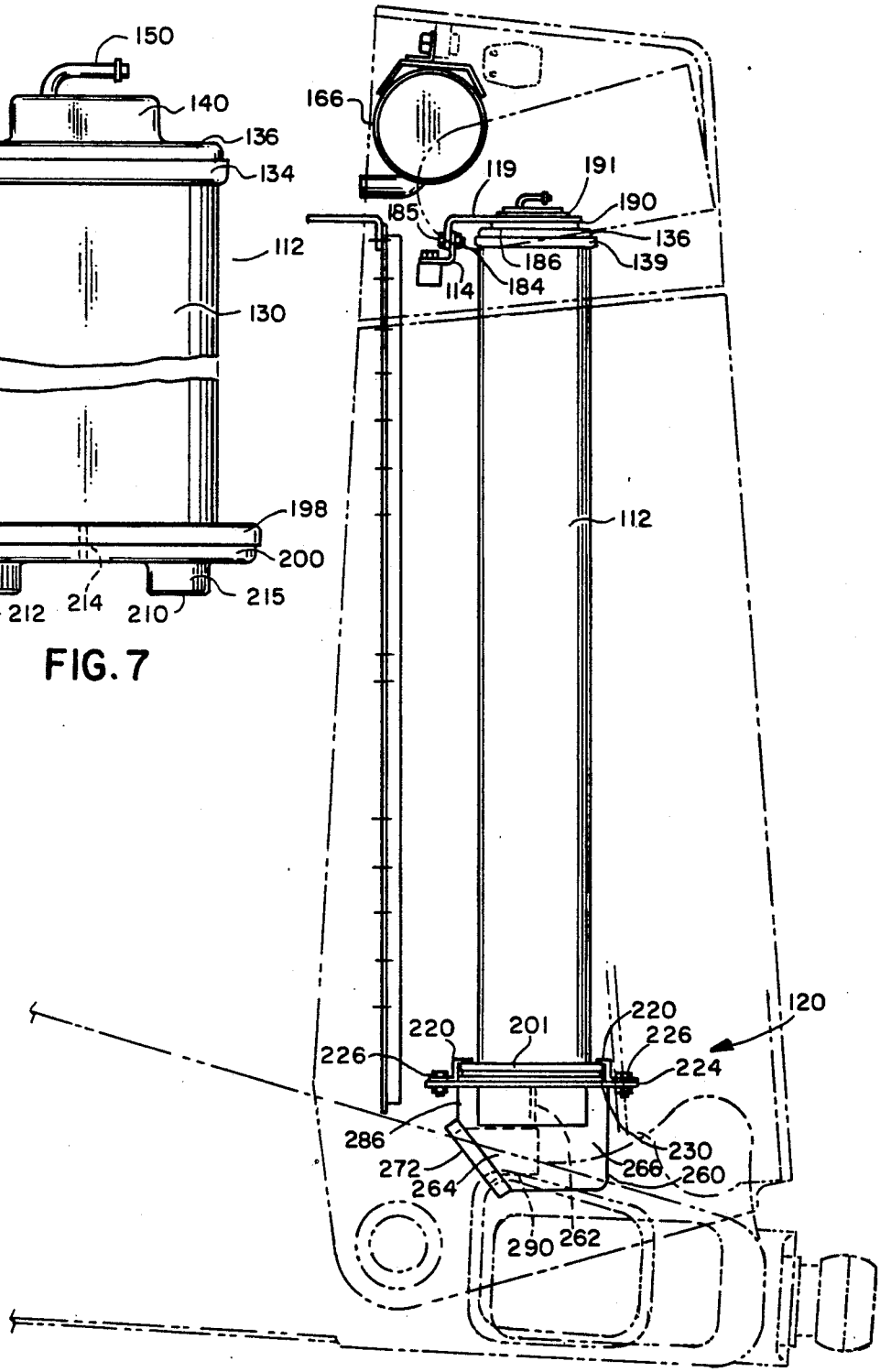
FIG. 8 is a side elevation of the module of FIG. 7 attached to the heat exchanger.

As shown in FIGS. 6 through 8, each tank has two vent tubes 150. In an alternate design, though not shown, there would be one vent tube 150 per tank and adjacent tank vent tubes would be brought into fluid communication by means of T-shaped hoses.

Alternatively, the modules 112 can be incorporated in the radiator in an inverted position wherein the tanks 139 are lowermost. In that event, the tubes 150 may function as drains when the radiator is to be emptied.

Referring to FIGS. 8–11, the retaining plates 119 are L-shaped and fit over the upper exterior surfaces of corresponding tank halves 136. Each plate 119 has a hole 182 therethrough for receipt of the corresponding positioning stud 140. Each retaining plate 119 also has a flange 184 for attachment to the tank retainer 114 by bolts 185. Because the vent tubes 150 are within the envelope of the studs 140, the latter are easily inserted into the openings 182.

Figure 12:
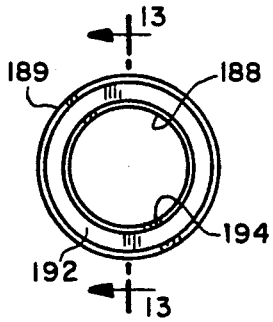
FIG. 12 is a top view of an upper tank grommet.
Figure 13:
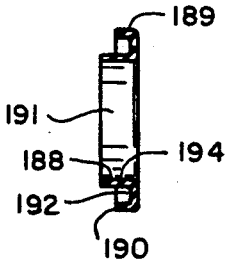
FIG. 13 is a side view of a portion of the grommet of FIG. 12.

Referring to FIGS. 8, 12 and 13, a grommet 186 is positioned between each tank half 136 and the associated retaining plate 119. The grommet 186 is made of a rubber or elastomer which absorbs the effects of thermal expansion and vibration of the module 112. The grommet 186 includes concentric, spaced radially inner and outer cylindrical surfaces 188 and 189, respectively, each with respective upper end surfaces 190,191, and an intermediate peripheral channel or groove 192 therebetween which enhances compressibility. The grommet 186 has a central opening 194 which fits tightly around the positioning stud 140.

The outer surface 189 is shorter than the inner surface 188 and protects against the effects of axial vibrations and thermal expansion. The top or end 190 of the shorter surface 189 abuts the underside of the upper retaining plate 119 to absorb axial components of vibrations. The longer inner surface 191 extends through the opening 182 to be interposed between each stud 140 and the respective retaining plate 119 to protect against the effects of radial vibrations. That is, the longer surface 191 extends past the position where the retaining plate opening 182 meets the stud 140 to provide insulation between the metallic materials and absorb the radial components of vibrations and the effects of thermal expansion.

Figure 11:
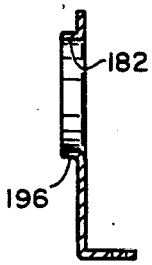
FIG. 11 is a side view of the retainer of FIG. 10.

Referring to FIG. 11, in a preferred embodiment, the retaining plate 119 has a lip 196 surrounding the hole 182 which fits around the stud 140 and ends below the top of the stud 140. Though not shown, the lip 196 fits around the exterior of the longer inner surface 191. The use of the lip 196 reduces loading on the grommet 186 in the radial direction relative to the hole 182.

In general, in addition to the isolation mentioned, the grommet 186 relaxes tolerance requirements of the system.

Referring to FIG. 7, at the opposite end of the module from the upper tank 139, the tube bundle of each module terminates in a header plate 198 in which the ends of the tubes 130 are bonded and sealed. The header plate 198 is somewhat cupped-shaped and opens downwardly to receive a shallow upwardly-opening tank half 200. The header plate 198 and tank half 200 define a lower tank 201. The design of the lower tank 201 is the same as that described in the first embodiment, having an inlet snout and an outlet snout, 210 and 212, respectively, on opposite sides of a baffle 214 which divides the lower tank into substantially two equal sections, an inlet section, 215, and an outlet section, 216.

Figure 14:
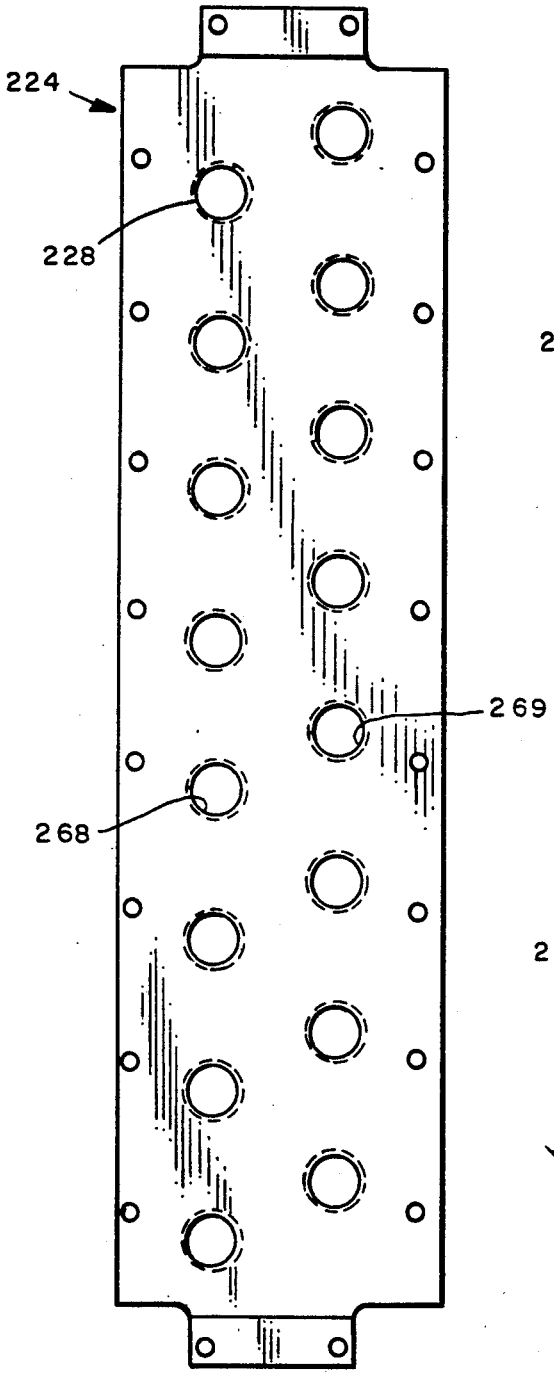
FIG. 14 is a plan view of a lower manifold plate.

Referring to FIGS. 8 and 14, Z-brackets 220 secure the lower tanks 201 of each of the modules 112 to a plate 224 forming the top of the manifold 120 by means of bolts 226. The plate 224 has a plurality of generally circular holes or ports 228 for receipt of the inlet and outlet snouts 210 and 212 of each of the modules to connect with corresponding ports 228 in the manifold 120.

Figure 15:
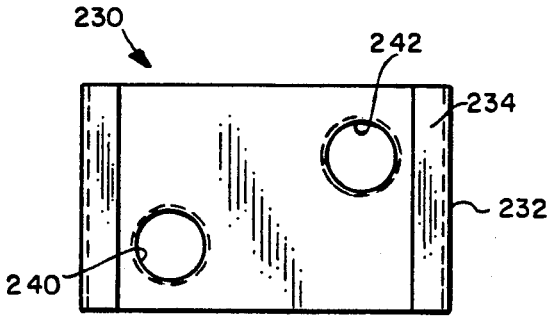
FIG. 15 is an end view of a lower tank grommet.
Figure 16:
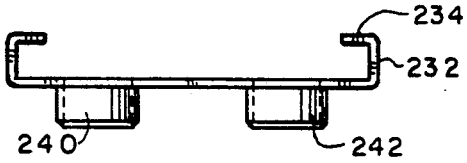
FIG. 16 is a side elevational view of the lower tank grommet of FIG. 15.
Figure 17:
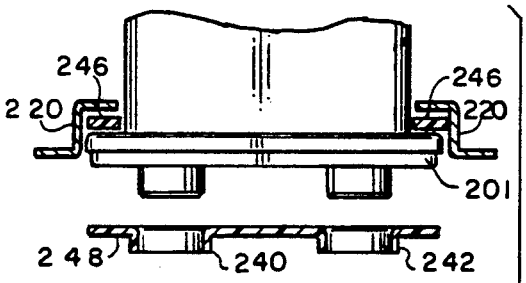
FIG. 17 is an exploded view of an alternate embodiment of the lower tank grommet.

Referring to FIGS. 15 and 16, a lower mount grommet 230 is positionable around the lower tank 201 of each module, fitting between the lower tank 201 and the corresponding portion of the plate 224, and the Z-brackets 220. The grommet 230 is C-shaped with side walls 232 and top flanges 234 that fit tightly around the lower tank 201 providing isolation from the plate 224 and Z-brackets 220. The second portion of the grommet 230 also has cylindrical appendages 240 and 242 that surround the inlet and outlet snouts, 210 and 212, to provide isolation between the lower tank 201 and the manifold 120 thereat. Referring to FIG. 17, in alternate embodiment the grommet 230 is in two separate sections. One section 246 is located between the Z-brackets 220 and the tank 201. A second section 248 is configured like the bottom of the grommet 230 and is on the lower tank 201 between the corresponding portion of the plate 224. The grommet 230, which is made of a rubber or elastomer, acts as both a seal and an insulator to prevent abrasion from the metals rubbing against each other when the module 112 vibrates and to seal the interface of each module 112 and the manifold 120. The resilient material absorbs both vibrations and the effects of thermal expansion.

In addition to the plate 224, the manifold 120 includes an elongated U-shaped enclosure 260. A baffle 262 is disposed vertically lengthwise along the interior of the enclosure which divides the manifold into substantially two equal U-shaped chambers 264,266 functioning as the inlet and outlet chambers. The baffle 262 extends from the base of the enclosure up to the plate 224 providing for separate isolated chambers so that one row of ports 228 are inlet ports 268 and the other row are outlet ports 269.

Referring to FIGS. 6 and 8, the manifold 120 has inlet and outlet openings 270 and 272, along one face 280 of the manifold 120, adjacent the inlet chamber 264. Referring to FIG. 8, a tube 290 connects the outlet chamber 266 to the outlet opening 272 through the inlet chamber 266 and baffle 262.

Fluid is brought into the manifold inlet chamber 264 through the manifold inlet opening 270. As in the previous embodiment, the manifold baffle 262 keeps the fluid from directly entering the outlet chamber 266 of the manifold 120. The fluid moves up into the inlet sections 215 of all of the module lower tanks 201 through the respective module inlet snouts 210.

The lower tank baffles 214 in the modules 212 keep the fluid from directly entering the outlet sections 216 of the lower tanks 201. Therefore, the fluid flows up those of the tubes 130 in fluid communication with the inlet sections 215, up to the upper tanks 139 and then down through the other of the tubes 130 and into the outlet sections 216 of the lower tanks 201. From there the fluid flows through the outlet snouts 212 of the modules 112 and respective outlet ports 269 in the manifold plate 224 through the tube 290 in the manifold 120 to the outlet opening 272.

Those skilled in the art will appreciate that the foregoing construction retains all of the advantages heretofore known and associated with modular constructions while achieving new ones. Each individual module can be removed simply by loosening the tank retainers 14 or 220. Thus extensive disassembly as is required with folded front type modular assemblies is avoided.

A heat exchanger made according to the present invention employs only a single manifold 20, 120 thereby eliminating the expense that accompanies use of upper and lower manifolds found in some designs.

The use of a multi-pass, counterflow flow pattern enabled through the use of the modules, and particularly, the presence of the baffle 60 in the lower tanks, improves heat transfer efficiency.

It should also be noted that since the ports 62 and 64 or 215 and 216 are on the same end of each module, it is not necessary to maintain tight tolerances during manufacture as might be the case in other systems where the ports are on opposite sides or ends of the individual modules.

Moreover, the vents 150 provide for the release of gases from the system which enhances the heat exchange capabilities. The grommets 186 and 230 on the upper and lower tanks 139 and 201 absorb vibrations that would otherwise damage the radiator and thus extend the overall life of the system.

We claim:

1. A module for a modular heat exchanger comprising:

first and second spaced tanks;

a plurality of rows of tubes extending between said tanks and in fluid communication with the interiors of said tanks, each of said rows having a plurality of tubes, each tube having a first end opening to and within said first tank and a second end opening to and within said second tank;

fins extending between said tubes on the exterior thereof;

a positioning snout on one of said tanks and adapted to be received in a frame to position said one tank with respect thereto;

at least one fluid port in the other of said tanks; and a baffle within said other tank to one side of said port and preventing fluid flow between said port and the side of said other tank on the side of said baffle opposite from said port except through the tubes and said one tank, wherein said tubes have flattened sides and said baffle is elongated and is generally transverse to said flattened side.

2. A heat exchanger including an elongated frame member having a plurality of spaced positioning snout receiving formations extending along its length and a plurality of manifold modules in side-by-side relation and spaced from and parallel to said frame member, each of said manifold modules having at least one channel extending in the direction of elongation of said frame member and aligned with and sealed to the channel in the adjacent manifold module or modules; a plurality of the modules of claim 1 located between said manifold modules and said frame members in side-by-side relation; and means in each manifold module for establishing fluid communication between the fluid port of the corresponding module of claim 1 and the associated channel.

3. The module for a modular heat exchanger of claim 1 further comprising at least one vent to the exterior of one of said tanks.

4. The module for a modular heat exchanger of claim 3 wherein said vent is on said snout.

5. The module for a modular heat exchanger of claim 4 wherein said vent is a tube protruding upwardly from said snout having a portion bent so as to be in a plane parallel to said snout, said bent portion having a lesser lengthwise magnitude than the cross sectional length of the portion of said snout parallel to said tube bent portion.

6. A modular heat exchanger comprising:

an elongated manifold having spaced, interior inlet and outlet channels, said manifold having a front side and a rear side with said outlet channel nearer said front side than said inlet channel;

a plurality of spaced inlet ports along said manifold, each in fluid communication with said inlet channel;

a plurality of spaced outlet ports along said manifold, each in fluid communication with said outlet channel;

an elongated frame member spaced from and parallel to said manifold and having a plurality of spaced retaining formations thereon; and a plurality of heat exchanger modules mounted between said frame member and aid manifold in side-by-side relation, each said module having spaced tanks with a plurality of finned tubes extending between and in fluid communication with said tanks, one tank having a mating retaining formation mating with a corresponding retaining formation on said frame member, the other tank having an inlet and an outlet port aligned with and in fluid communication with a corresponding inlet port and a corresponding outlet port in said manifold, a baffle in said other tank between the inlet and outlet ports thereof to isolate the same from each other within said other tank, and resilient seal means between said other tanks and said manifold and a vibration damper between said one tanks and said frame member.

7. The modular heat exchanger of claim 6 wherein said baffles are generally parallel to said front side.

8. A modular heat exchanger comprising:

an elongated manifold having spaced, interior inlet and outlet channels, said manifold being made up of a plurality of manifold modules in side-by-side, sealed relation with each said manifold module having at least one inlet port and at least one outlet port;

a plurality of spaced inlet ports along said manifold, each in fluid communication with said inlet channel;

a plurality of spaced outlet ports along said manifold, each in fluid communication with said outlet channel;

an elongated frame member spaced from and parallel to said manifold and having a plurality of spaced retaining formations thereon; and a plurality of heat exchanger modules mounted between said frame member and said manifold in side-by-side relation, each said module having spaced tanks with a plurality of finned tubes extending between and in fluid communication with said tanks, one tank having a mating retaining formation mating with a corresponding retaining formation on said frame member, the other tank having an inlet and an outlet port aligned with and in fluid communication with a corresponding inlet port and a corresponding outlet port in said manifold, a baffle in said other tank between the inlet and outlet ports thereof to isolate the same from each other within said other tank, and resilient seal means between said other tanks and said manifold and a vibration damper between said one tanks and said frame member.

9. A modular heat exchanger comprising:

an elongated manifold having spaced, interior inlet and outlet channels;

a plurality of spaced inlet ports along said manifold, each in fluid communication with said inlet channel;

a plurality of spaced outlet ports along said manifold, each in fluid communication with said outlet channel;

an elongated frame member spaced from and parallel to said manifold and having a plurality of spaced retaining formations thereon; and a plurality of heat exchanger modules mounted between said frame member and said manifold in side-by-side relation, each said module having spaced tanks with a plurality of finned tubes extending between and in fluid communication with said tanks, one tank having a mating retaining formation mating with a corresponding retaining formation on said frame member, the other tank having an inlet and an outlet port aligned with an in fluid communication with a corresponding inlet port and a corresponding outlet port in said manifold, a baffle in said other tank between the inlet and outlet ports thereof to isolate the same from each other within said other tank, and resilient seal means between said other tanks and said manifold and a vibration damper between said one tanks and said frame member;

each said module having a centerline, each said mating retaining formation being disposed on said centerline, each said inlet and outlet for said other tanks being identical and located diametrically opposite of one another about said centerline and equally spaced therefrom.

10. A modular heat exchanger comprising:

an elongated manifold having spaced interior inlet and outlet channels;

a plurality of spaced inlet ports along said manifold, each in fluid communication with said inlet channel;

a plurality of spaced outlet ports along said manifold, each in fluid communication with said outlet channel;

an elongated frame member spaced from and parallel to said manifold and having a plurality of spaced retaining formations thereon; and a plurality of heat exchanger modules mounted between said frame member and said manifold in side-by-side relation, each said module having first and second spaced tanks with a plurality of finned tubes extending between and in fluid communication with said tanks, said first tank having a mating retaining formation mating with a corresponding mating formation on said frame member, said second tank having an inlet and outlet and an outlet port aligned with and in fluid communication with a corresponding inlet port and a corresponding outlet port in said manifold, a baffle in said other tank between the inlet and outlet ports thereof to isolate the same from each other within said tank, and said first tank having at least one vent extending from the tank mating retaining formation;

said vents on said modules being connected to each other so that the modules are in fluid communication thereat.

11. The modular heat exchanger of claim 10 wherein each said module has two tubular vents with a U-shaped tube connecting adjacent vents between adjacent modules.

12. The modular heat exchanger of claim 10 further comprising a grommet positioned between said first tank and said retaining formation for absorbing vibrations.

13. The modular heat exchanger of claim 12 wherein said grommet is composed of rubber.

14. The modular heat exchanger of claim 12 wherein said grommet comprises an inner ledge, an outer ledge and a channel between said ledges, said outer ledge being a shorter height than said inner ledge.

15. The modular heat exchanger of claim 12 further comprising a grommet for absorbing vibrations positioned between said second tank and said manifold.

16. A module for a modular heat exchanger comprising:

first and second spaced tanks interconnected by a tube bundle;

a positioning snout on one of said tanks and adapted to be received in a frame to position said one tank with respect thereto;

hydraulically separate inlet and outlet ports in the other of said tanks; and at least one vent on said snout.

17. The heat exchanger of claim 16 further comprising:

a plurality of rows of tubes extending between said tanks and in fluid communication with the interiors of said tanks, each of said rows having a plurality of tubes, each tube having a first end opening to and within said first tank and a second end opening to and within said second tank; and fins extending between said tubes on the exterior thereof.

18. A heat exchanger including an elongated frame member and an elongated manifold spaced and parallel to said frame, said manifold having inlet and outlet channels extending in the direction of elongation; a plurality of the modules of claim 18 located between said manifold and said frame in side-by-side relation and means in said manifold for establishing communication between said inlet and outlet ports and said inlet and outlet channels respectively; wherein said vents on said snouts are in direct fluid communication with at least one vent on an adjacent module.

19. A modular heat exchanger comprising:

an elongated manifold having spaced interior inlet and outlet channels;

a plurality of spaced inlet ports along said manifold, each in fluid communication with said inlet channel;

a plurality of spaced outlet ports along said manifold, each in fluid communication with said outlet channel;

an elongated frame member spaced from and parallel to said manifold having a plurality of retaining plates attached thereto aligned in a row, said plates having at least one opening therethrough; and a plurality of heat exchange modules mounted between said frame member and said manifold in side-by-side relation, each said module having first and second spaced tanks, said first tank having a snout that mates with said plate opening.

20. The heat exchanger of claim 19 further comprising a vent in said snout.

21. The heat exchanger of claim 19 further comprising a grommet between each of said snouts and each corresponding plate.

22. The heat exchanger of claim 21 wherein said snout is generally cylindrical and said grommet has a first generally cylindrical wall of generally the same vertical height as said snout and a second generally cylindrical wall having a channel between said first wall and said second wall, said second wall having a vertical height slightly less than the distance of said plate from the top of said first tank.

23. The heat exchanger of claim 22 wherein said plate is L-shaped with a first generally planar portion containing said opening and having a generally cylindrical surface surrounding said opening, said surface being positionable around said grommet first wall.

24. The heat exchanger of claim 19 wherein said second tank has at least one port aligned with and in fluid communication with a corresponding port in said manifold.

25. The heat exchanger of claim 24 further comprising a grommet positioned between said second tank port and said corresponding manifold port, said grommet functioning as a seal and a vibration damper.

26. The heat exchanger of claim 25 wherein said tank has a generally cylindrical inlet port and a generally cylindrical outlet port that mate with corresponding inlet and outlet ports in said manifold, said grommet having a planar portion and cylindrical sections depending from said planar portion, said cylindrical sections tightly fitting over said cylindrical tank ports.

27. The heat exchanger of claim 26 further comprising Z-brackets attaching said second tank to said manifold, said grommet fitting between said Z-bracket and said tank.

28. The heat exchanger of claim 27 wherein said grommet has spaced parallel walls protruding from said planar portion in the opposite direction from said cylindrical sections, said walls fitting between said second tank and said Z-brackets.

* * * * *

UNITED STATES PATENT AND TRADEMARK OFFICE

CERTIFICATE OF CORRECTION

PATENT NO. : 5,137,080

DATED : August 11, 1992

INVENTOR(S) : Haasch, et. al.

It is certified that error appears in the above-indentified patent and that said Letters Patent is hereby corrected as shown below:

Column 10, Claim 6, line 37, change "aid" to --said--.

Column 11, Claim 9, line 42, change "an" (third occurrence) to --and--.

Column 12, Claim 18, line 61, change "18" to --16--.

Signed and Sealed this

Nineteenth Day of October, 1993

*Attest:*

*Attesting Officer*

BRUCE LEHMAN

*Commissioner of Patents and Trademarks*